United States Patent [19]

König et al.

[11] Patent Number: 4,806,255

[45] Date of Patent: * Feb. 21, 1989

[54] TEXTILE TREATMENT COMPOSITIONS

[75] Inventors: Axel König, Wemmel; Francesco de Buzzaccarini, Strombeek-Bever, both of Belgium

[73] Assignee: The Procter & Gamble Company, Cincinnati, Ohio

[ * ] Notice: The portion of the term of this patent subsequent to Apr. 28, 2004 has been disclaimed.

[21] Appl. No.: 850,638

[22] Filed: Apr. 10, 1986

[30] Foreign Application Priority Data

Aug. 20, 1985 [GB] United Kingdom ..... 8520803

[51] Int. Cl.[4] ..... D06M 11/00

[52] U.S. Cl. ..... 252/8.8; 252/8.75; 252/355

[58] Field of Search ..... 252/8.8, 8.75, 355

[56] References Cited

U.S. PATENT DOCUMENTS

| | | | |
|---|---|---|---|
| 2,995,520 | 8/1961 | Luvisi | 252/8.8 |
| 3,644,203 | 2/1972 | Lamberti et al. | 252/8.75 |
| 3,681,241 | 8/1972 | Rudy | 252/8.75 |
| 3,775,316 | 11/1973 | Berg | 252/8.8 |
| 3,904,533 | 9/1975 | Neiditch et al. | 252/8.8 |
| 3,974,076 | 8/1976 | Wiersema et al. | 252/8.8 |
| 4,326,971 | 4/1982 | Wixon | 252/8.75 |
| 4,329,237 | 5/1982 | Wixon | 252/8.75 |
| 4,383,063 | 5/1983 | Rees | 252/8.75 |
| 4,399,045 | 8/1983 | Burns | 252/8.75 |
| 4,411,803 | 10/1983 | Wixon | 252/8.75 |
| 4,416,811 | 11/1983 | Wixon | 252/8.75 |
| 4,424,134 | 1/1984 | Sissin et al. | 252/8.8 |
| 4,426,299 | 1/1984 | Verbruggen | 252/8.8 |
| 4,439,335 | 3/1984 | Burns | 252/8.75 |
| 4,450,085 | 5/1984 | Wixon | 252/8.75 |
| 4,454,049 | 12/1984 | MacGilp et al. | 252/8.8 |
| 4,460,485 | 7/1984 | Rapisarda et al. | 252/8.75 |
| 4,464,272 | 8/1984 | Parslow et al. | 252/8.8 |
| 4,661,267 | 4/1987 | Dekker et al. | 252/8.8 |
| 4,661,269 | 4/1987 | Trinh et al. | 252/8.8 |

FOREIGN PATENT DOCUMENTS

| | | |
|---|---|---|
| 0000406 | 1/1979 | European Pat. Off. . |
| 1565808 | 4/1980 | United Kingdom . |
| 1601360 | 10/1981 | United Kingdom . |
| 1601758 | 11/1981 | United Kingdom . |
| 2118221 | 10/1983 | United Kingdom . |

OTHER PUBLICATIONS

Fette-Seifen-Anstrichmittel, 74:527-533, 1972, H. W. Eckert, Henkel & Co., Inc., "Condensation Products from β-Hydroxyethylenediamine and Fatty Acids or Their Alkyl Esters and Their Application as Textile Softeners in Washing Agents" (Translation).

Ser. No. 717,051 filed 3-28-85 by Trinh et al.

*Primary Examiner*—Paul Lieberman

*Assistant Examiner*—Willie J. Thompson

*Attorney, Agent, or Firm*—Robert B. Aylor; Ronald L. Hemingway; Richard C. Witte

[57] ABSTRACT

Aqueous dispersions of certain amines, with Bronstedt acids having a pKa of at least 6, are stable and are useful as rinse-added fabric softeners.

8 Claims, No Drawings

TEXTILE TREATMENT COMPOSITIONS

This invention relates to textile treatment compositions. More particularly it relates to textile treatmment compositions suitable for use in the rinse cycle of a textile laundering operation to provide fabric softening/static control benefits, the compositions being characterized by excellent softening, water dispersability and storage properties after prolonged storage at both elevated and sub-normal temperatures.

Textile treatment compositions suitable for providing fabric softening and static control benefits during laundering are well known in the art and have found widespread commercial application. Conventionally, rinse-added fabric softening compositions contain, as the active component, substantially water-insoluble cationic materials having two long alkyl chains. Typical of such materials are di-hardened tallow dimethylammonium chloride, and imidazolinium compounds substituted with two tallow groups. These materials are normally prepared in the form of a dispersion in water and it is generally not possible to prepare such aqueous dispersions with more than about 10% of cationic softener without encountering severe product viscosity and storage-stability problems. Although more concentrated dispersions of softener materials can be prepared as described in European Patent Application No. 0 000 406 and British Pat. No. 1 601 360 by incorporating certain nonionic adjunct softening materials therein, such compositions tend to be relatively inefficient in terms of softening benefit/unit weight of active; moreover, product viscosity and stability problems become increasingly unmanageable in more concentrated aqueous dispersions and effectively limit the commercial range of applicability to softener active levels in the range from about 15% to about 20%.

U.S. Pat. No. 4,454,049, issued June 12, 1984 to MacGilp et al discloses concentrated liquid fabric softeners comprising substantial amounts at least 10%, more typically about 30–40%, of water miscible organic solvent.

U.S. Pat. No. 2,995,520, issued Aug. 8, 1961 to Luvisi et al discloses the use of the acid salts of certain imidazoline derivatives for softening of fibrous materials such as cotton and paper. The treatment baths used for treating textiles contain from 0.001% to 1% of an acid salt of an imidazoline derivative. For shipment, it is said to be desirable to place the materials in a low molecular weight aliphatic alcohol to prevent freezing.

Other patents, more recent than U.S. Pat. No. 2,995,520, also disclose the use of an acid salt of an imidazoline derivative for the softening of fabrics. However, according to the state of the art, quaternary ammonium salts are, in the context of fabric softening, preferred over acid salts of, e.g., acyclic tertiary amines or cyclic amines.

It is therefore an object of the present invention to provide liquid fabric softening compositions that can be formulated as both diluted and concentrated aqueous dispersions without the need of significant amounts of organic solvents. The compositions of the present invention have excellent stability at both elevated and sub-normal temperatures, even under prolonged storage conditions. These compositions further provide excellent softening, anti-static and fabric rewettability characteristics across a broad range of fabric types.

SUMMARY OF THE INVENTION

The present invention provides a stable aqueous dispersion comprising:

(a) from 1% to 40% of an amine selected from the group consisting of the di(higher alkyl) cyclic amines of formula I herein; and mixtures thereof; and (b) a compound selected from the group of conventional quaternary ammonium softening agents;

having two higher alkyl groups, each comprising from 8 to 30 carbon atoms.

DETAILED DESCRIPTION OF THE INVENTION

The compositions of the present invention are based upon the discovery that stable aqueous dispersion can be formulated with certain cyclic amines, even at high amine concentration, and a conventional di(higher alkyl) quaternary ammonium salt, without the use of substantial amounts of organic solvent.

(a) The amine

The amines used in the compositions of the present invention are selected from the group consisting of: (I) compounds of the formula I

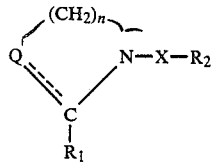

Formula I wherein n is 2, 3 or 4, preferably 2; $R_1$ and $R_2$ are, independently, a $C_8$–$C_{30}$ alkyl or alkenyl, preferably $C_{11}$–$C_{22}$ alkyl, more preferably $C_{15}$–$C_{18}$ alkyl, or mixtures of such alkyl radicals. Examples of such mixtures are the alkyl radicals obtained from coconut oil, "soft" (non-hardened) tallow, and hardened tallow. Q is CH, $CH_2$, NL, or N, preferably N.

X is $$-R_4-T-\underset{\underset{O}{\|}}{C}-$$

wherein T is $NR_5$, $R_5$ being H or $C_1$–$C_4$ alkyl, preferably H, and $R_4$ is a divalent $C_1$–$C_3$ alkylene group or $(C_2H_4O)_m$, wherein m is an number of from 1 to 8; or X is $R_4$.

The compositions of the present invention comprise from 1% to 40% by weight of the amine, preferably from 2% to 35%, and more preferably from 2% to 20%.

Detergent carryover, as may take place in a laundry process, particularly under conditions as prevail in U.S. washing machines, tends to negatively affect the softening performance of rinse added softeners. It has been found that the amines of formula I are less sensitive to detergent carryover than, e.g. ditallowdimethylammonium chloride.

(b) Quaternary ammonium salt

As a second component, the dispersions herein contain a conventional di(higher alkyl) quaternary ammonium softening agent. By "higher alkyl" as used in the context of the quaternary ammonium salts herein is meant alkyl groups having from 8 to 30 carbon atoms, preferably from 11 to 22 carbon atoms. Examples of such conventional quaternary ammonium salts include (i) acyclic quaternary ammonium salts having the formula:

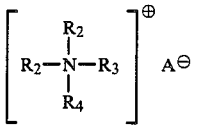

wherein $R_2$ is an acyclic aliphatic $C_{15}$–$C_{22}$ hydrocarbon group. $R_3$ is a $C_1$–$C_4$ saturated alkyl or hydroxyalkyl group, $R_4$ is selected from $R_2$ and $R_3$, and A is an anion.

(ii) diamido quaternary ammonium salts having the formula:

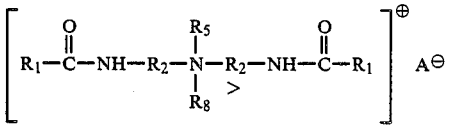

wherein $R_1$ is an acyclic aliphatic $C_{15}$–$C_{21}$ hydrocarbon group, $R_2$ is a divalent alkylene group having 1 to 3 carbon atoms, $R_5$ and $R_8$ are $C_1$–$C_4$ saturated alkyl or hydroxyalkyl groups, and $A^-$ is an anion;

(iii) diamido alkoxylated quaternary ammonium salts having the formula:

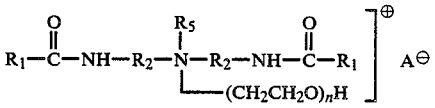

wherein n is equal to 1 to about 5, and $R_1$, $R_2$, $R_5$ and $A^-$ are as defined above;

(vi) quaternary imidazolinium compounds.

Examples of Component (i) are the well-known dialkyldimethylammoniums salts such as ditallowdimethylammonium chloride, ditallowdimethylammonium methylsulfate, di(hydrodrogenated tallow) dimethylammonium chloride, distearyldimethylammonium chloride, dibehendyldimethylammonium chloride.

Examples of Component (ii) are methylbis(tallowamidoethyl) (2-hydroxyethyl) ammonium methylsulfate and methylbis(hydrogenated tallowamidoethyl) (2-hydroxyethyl) ammonium methylsulfate wherein $R_1$ is an acyclic aliphatic $C_{15}$–$C_{17}$ hydrocarbon group, $R_2$ is an ethylene group, $R_5$ is a methyl group, $R_8$ is a hydroxyalkyl group and A is a methylsulfate anion; these materials are available from Sherex Chemical Company under the trade names Varisoft® 222 and Varisoft® 110, respectively.

Examples of (iv) are 1-methyl-1-tallowamido-ethyl-2-tallowimidazolinium methylsulfate and 1-methyl-1-(hydrogenated tallowamidoethyl)-methylsulfate.

The quaternary ammonium salt (b) preferably comprises from 1% to 20%, more preferably 2% to 20% by weight of the composition herein.

The weight ratio amine (a):quaternary ammonium salt (b) is in the range from 10:1 to 1:10, preferably from 3:1 to 1:3.

The di(higher alkyl)imidazolinium compounds are preferred for use herein, in particular the 1-(lower alkyl)-1-(higher alkyl)amidoethyl-2-(higher alkyl) imidazolinium compounds, wherein "lower alkyl" signifies alkyl having from 1 to 4 carbon atoms, and "higher alkyl" signifies alkyl having from 11 to 22 carbon atoms.

(c) Optional Bronstedt acid

The dispersion may further comprise Bronstedt acids having a pKa value of 6 or less.

The amount of acid should be such that the pH of the dispersion, after mixing, is not greater than 5, preferably not greater than 4, and most preferably in the range of from 2.5–4. Typically, the amount of acid is from 1% to 50% by weight of the amine, preferably from 2% to 30%, most preferably from 3 to 15%.

Examples of suitable acids include the inorganic mineral acids, carboxylic acids, in particular the low molecular weight ($C_1$–$C_5$) carboxylic acids, aromatic carboxylic acids, like benzoic acid, and alkysulfonic acids.

Suitable ionorganic acids include HCl, HBr, $H_2SO_4$, $HNO_3$ and $H_3PO_4$. Suitable organic acids include benzoic acid, formic, acetic, methylsulfonic and ethylsulfonic acid. Preferred acids are phosphoric, formic and methylsulfonic acid.

(d) Organic solvent

The compositions of the present invention can be formulated without the use of any organic solvent. However, the presence of organic solvents (for example, low molecular weight, water mascible aliphatic alcohols,) does not harm the storage stability, the viscosity, or the softening performance of the compositions of this invention.

Typically, the amine will be obtained from a supplier of bulk chemicals in solid form of as a solution in an organic solvent, e.g. isopropanol. There is no need, whatsoever, to remove such a solvent in making the compositions of this invention. Indeed, additional solvent may be added, if this is deemed desirable.

However, compared to water, organic solvents are expensive, and difficult to handle because of their flammability and, sometimes, toxicity. It is therefore desirable to formulate the present compositions with low levels of organic solvent, i.e., less than 10%, preferably less than 2%.

(e) Optional silicone Component

The compositions herein can optionally contain an aqueous emulsion of a predominantly linear polydialkyl or alkyl, aryl siloxane in which the alkyl groups can have from one to five carbon atoms and may be wholly or partially fluorinated. Suitable silicones are polydimethyl siloxanes having a viscosity at 25° C. in the range from 100 to 100,000 centistokes, preferably in the range from 300 to 6,000 centistokes.

It has been found that the ionic charge characteristics of the silicone as used in the combination are important in determing both the extent of deposition and the evenness of distribution of the silicone and hence the properties of a fabric treated therewith.

Silicones having cationic character show an enhanced tendency to deposit. Silicones found to be of value in providing fabric feel benefits have a predominantly linear character and are preferably polydialkyl siloxanes in which the alkyl group is most commonly methyl. Such silicone polymers are frequently manufactured commercially by emulsion polymerisation using a strong acid or strong alkali catalyst in the presence of a nonionic or mixed nonionic-anionic emulsifier system.

In the present invention, the optional silicone component embraces a silicone of cationic character which is defined as being one of (a) a predominantly linear di $C_1$–$C_5$ alkyl or $C_1$–$C_5$ alkyl, aryl siloxane, prepared by emulsion polymerisation using a cationic surfactant as emulsifier.

(b) an alpha-omega-di quaternised di $C_{1-5}$ alkyl or $C_1$–$C_5$ alkyl, aryl siloxane polymer or (c) an amino-functional di $C_1$–$C_5$ alkyl or alkyl aryl siloxane polymer in which the amino group may be substituted and may be quaternised and in which the degree of substitution (d.s.) lies in the range 0.001 to 0.1, preferably 01–0.075;

provided that the viscosity at 25° C. of the silicone is from 100 to 100,000 cs.

The weight ratio of the siloxane to the amine component of the composition herein typically ranges from 5:1 to 1:100, preferably from 2:1 to 1:10.

The silicone component suitable for use herein are more fully disclosed in British Pat. No. 1.549.180.

(f) Optional nonionics

The compositions optionally contain nonionics as have been disclosed for use in softener compositions. Such nonionics and their usage levels, have been disclosed in U.S. Pat. No. 4,454,049, issued June 12, 1984 to Mac Gilp et al., the disclosures of which are incorporated herein by reference.

Specific examples of nonionics suitable for the compositions herein include glycerol esters (e.g., glycerol monostearate), fatty alcohols (e.g., stearyl alcohol), and alkoxylated fatty alcohols. The nonionics, if used, are typically used at a level in the range of from 0.5–10% by weight of the composition.

(g) Other Optional Ingredients

In order to further improve the stability of the compositions herein, and further adjust their viscosities, these compositions can contain relatively small amounts of electrolyte. A highly preferred electrolyte is $CaCl_2$. It has been found that the Brookfield viscosities of highly concentrated dispersions can be reduced to less than 100 cps, using relatively small amounts of $CaCl_2$ (e.g., 600 ppm).

The compositions herein can optionally contain other ingredients known to be suitable for use in textile softeners. Such adjuvents include perfumes, preservatives, germicides, colorants, dyes, fungicides, stabilizers, brighteners and opacifiers. These adjuvents, if used, are normally added at their conventional levels. However, in the case of composition ingredients utilized for a fabric treatment effect, e.g., perfumes, these materials can be added at higher than normal levels, corresponding to the degree of concentration of the product.

EXAMPLES I–IV

The following compositions are prepared:

| | EX. I | EX. II | EX. III | EX. IV |
|---|---|---|---|---|
| DTI[1] | 20% | 10% | 8% | — |
| DTDMAC[2] | — | 10% | 12% | 15% |
| PDMS[3] | — | — | 1% | — |
| Acid | 0.2%[4] | — | — | 0.4%[5] |
| $CaCL_2$ (ppm) | 600 | 800 | 900 | 1200 |
| GMS[6] | — | 1% | — | — |
| Stearyl Alc. | — | — | 1% | — |
| Amine[7] | 10% | 8% | 5% | 10% |
| perfume | 0.9% | 0.9% | 0.9% | 0.7% |

-continued

| | EX. I | EX. II | EX. III | EX. IV |
|---|---|---|---|---|
| water | balance | balance | balance | balance |

[1]ditallow imidazolinium (1-methyl-1-tallow-amido-ethyl-2-imidazolinium chloride)
[2]ditallowdimethylammonium chloride
[3]polydimethyl siloxane, viscosity 500 centistokes
[4]formic acid
[5]methylsulfonic acid
[6]glycerolmonostearate
[7]1-tallowamidoethyl-2-tallowimidazoline Some hydrolysis of the ditallow imidazolinium component is observed to take place during processing. This is not found to markedly affect the softening performance of the compositions.

EXAMPLES V–VIII

The following examples are prepared, each having pH values in the range 2.5 to 5.

| Ingredient* | Ex V | Ex VI | Ex VII | Ex VIII |
|---|---|---|---|---|
| DTDMAC[1] | 2.33 | 7.0 | 1.26 | 3.78 |
| PDMS[2] | 1.33 | 5.0 | 0.333 | 1.0 |
| Amine[3] | 4.33 | 13 | 2.34 | 7.02 |
| HCl | 0.268 | 0.805 | 0.145 | 0.435 |
| $CaCl_2$ | 0.005 | 0.17 | — | 0.1 |
| Emulsifier[4] | 0.133 | 0.5 | 0.033 | 0.1 |
| Perfume/Dye | 0.252 | 0.753 | 0.251 | 0.752 |
| Water | to 100% | to 100% | to 100% | to 100% |

*All ingredients listed at percent by weight of compositions
[1]DTDMAC — As in Examples II, III and IV.
[2]PDMS — Polydimethylsiloxane, viscosity 5000 cs.
[3]Amine — 1-(2-$C_{14}$–$C_{18}$—Amidoethyl)-2-$C_{13}$–$C_{17}$—alkyl-4.5 dihydro-imidazoline; CAS number 72623-82-6.
[4]Emulsifier — As "Sapogenat T 100" (Trade Mark) for triisobutylphenol decaglycolether, Hoechst.

What is claimed:

1. A stable aqueous dispersion comprising:

(a) from 1% to 4% of an amine or mixture of amines selected from the group consisting of the di(higher alkyl) cyclic amines of the formula:

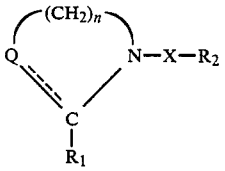

wherein n is 2, 3 or 4, $R_1$ and $R_2$ are, independently, a $C_8$–$C_{30}$ alkyl or alkenyl radical, or mixtures of such radicals; Q is CH, $CH_2$, NH or N, X is

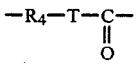

wherein T is $NR_5$, $R_5$ being H or $C_1$–$C_4$ alkyl, and $R_4$ is a divalent $C_1$–$C_3$ alkylene group or $(C_2H_4O)_m$, wherein m is a number of from 1 to 8; or X is $R_4$; and (b) a compound selected from the group of conventional quaternary ammonium softening agents having two higher alkyl groups, each comprising from 8 to 30 carbon atoms; and (c) from about 1% to about 50% by weight of the amine of a dispersing aid which is a Bronstedt acid having a pKa value of not greater than 6, the amount of said acid being such that the pH of the composition is 5 or less.

2. A dispersion according to claim 1 wherein the weight ratio (a):(b) is in the range from 3:1 to 1:3.

3. A dispersion according to claim 2 which comprises from 2% to 35% of the amine.

4. A dispersion according to claim 3 wherein the amine is a 1-(higher alkyl) amidoethyl-2-(higher alkyl) imidazoline, wherein higher alkyl represents an alkyl having from 11 to 22 carbon atoms.

5. A dispersion according to claim 4 wherein b. is selected from the 1-(lower alkyl)-1-(higher alkyl) amidoethyl-2-(higher alkyl) imidazolinium compounds, wherein lower alkyl represents alkyl having from 1 to 4 carbon atoms, and higher alkyl represents alkyl having from 11 to 22 carbon atoms.

6. A dispersion according to any one of the preceding claims which further comprises an emulsion of predominently linear di($C_1$–$C_5$) alkyl or $C_1$–$C_5$ alkylaryl siloxane in which the alkyl groups may be partially or wholly fluorinated and which may be substituted with cationic nitrogen groups, the siloxane having a viscosity at 25° C. of at least 100 centistokes and up to 100000 centistokes; the weight ratio of the siloxane content of the emulsion to the amine component being in the range of from 5:1 to 1:100.

7. A dispersion according to claim 6 wherein the siloxane is a polydimethyl siloxane.

8. A dispersion according to claim 6 which further comprises from 0.5% to 10% of a nonionic compound selected from the group consisting of glycerol esters, fatty alcohols and alkoxylated fatty alcohols.

* * * * *

UNITED STATES PATENT AND TRADEMARK OFFICE

CERTIFICATE OF CORRECTION

PATENT NO. : 4,806,255

DATED : February 21, 1989

INVENTOR(S) : AXEL KONIG and FRANCESCO DE BUZZACCARINI

It is certified that error appears in the above-identified patent and that said Letters Patent is hereby corrected as shown below:

Col. 2, line 46, after "is" insert -- 0 or --.

Col. 6, line 38, (Claim 1) "4%" should read -- 40% --.

Col. 7, line 4, (Claim 2) after "1:3" insert -- and the pH of the composition is less than about 4 --.

Signed and Sealed this

Third Day of April, 1990

*Attest:*

*Attesting Officer*

HARRY F. MANBECK, JR.

*Commissioner of Patents and Trademarks*